US012078436B2

(12) United States Patent
Curliss et al.

(10) Patent No.: US 12,078,436 B2
(45) Date of Patent: Sep. 3, 2024

(54) HYBRID COMPOSITE PROJECTILE BARREL

(71) Applicant: Proof Research, Inc., Columbia Falls, MT (US)

(72) Inventors: David Brian Curliss, Beavercreek, OH (US); Vincent Steffan Francischetti, Columbia Falls, MT (US); Nicholas Elmo Jack, Kalispell, MT (US)

( * ) Notice: Subject to any disclaimer, the term of this patent is extended or adjusted under 35 U.S.C. 154(b) by 166 days.

(21) Appl. No.: 17/941,837

(22) Filed: Sep. 9, 2022

(65) Prior Publication Data

US 2023/0184505 A1 Jun. 15, 2023

Related U.S. Application Data

(60) Provisional application No. 63/242,552, filed on Sep. 10, 2021.

(51) Int. Cl.

| | |
|---|---|
| ***F41A 21/02*** | (2006.01) |
| ***F41A 21/04*** | (2006.01) |
| ***F41A 21/24*** | (2006.01) |

(52) U.S. Cl.

CPC ..... *F41A 21/04* (2013.01); *F41A 21/24* (2013.01)

(58) Field of Classification Search

CPC ..... F41A 21/02; F41A 21/20; F41A 21/04; F41A 21/24

USPC ..... 42/76.02, 89, 16, 76.01, 78

See application file for complete search history.

(56) References Cited

U.S. PATENT DOCUMENTS 2,845,741 A * 8/1958 Harry, I ..... F41A 21/02 42/76.01
2,847,786 A * 8/1958 Harry, I ..... F41A 21/02 42/76.01
3,004,361 A * 10/1961 Hammer ..... F41A 21/02 42/76.02

(Continued)

FOREIGN PATENT DOCUMENTS

| | | |
|---|---|---|
| CN | 1837741 B | 5/2010 |
| CN | 204128429 U | 1/2015 |
| CN | 108643283 8 | 7/2018 |

OTHER PUBLICATIONS

The Dynamic Analysis of a Composite Overwrapped Gun Barrel With Constrained Viscoelastic Damping Layers Using the Modal Strain Energy Method, Braydon Day Hall, May 1, 2013.

*Primary Examiner* — Michael D David

(74) *Attorney, Agent, or Firm* — Antoinette M. Tease

(57) ABSTRACT

An improved hybrid composite projectile barrel comprising an inner liner and an outer composite matrix, the inner liner having a breech transition region and a muzzle transition region. The breech transition region and the muzzle transition region each comprises locking features that secure the outer composite matrix to the inner liner at the transition regions. In a first embodiment, the locking features are a series of longitudinally extending ribs with notches. In a second embodiment, the locking features are a plurality of pins disposed around the circumference of the breech and muzzle transition regions. In a third embodiment, the ridges and pins are combined such that a pin extends from the top of each ridge. In each embodiment with pins, the height of the pins is preferably adjusted so that the top ends of the pins form a line that is parallel with the outer diameter of the inner liner.

12 Claims, 5 Drawing Sheets

(56) References Cited

U.S. PATENT DOCUMENTS

| | | | | |
|---|---|---|---|---|
| 5,410,796 | A * | 5/1995 | Weeks, Jr. | F41A 21/02 29/419.1 |
| 5,657,568 | A * | 8/1997 | Christensen | F41A 21/02 42/76.01 |
| 7,721,478 | B2 * | 5/2010 | Withers | F41A 21/20 42/76.02 |
| 10,718,586 | B2 * | 7/2020 | Glisovic | F41A 21/24 |
| 11,079,194 | B1 * | 8/2021 | Sinnema | F41A 21/02 |
| 2007/0261286 | A1 * | 11/2007 | Briggs | F41A 21/04 42/76.02 |
| 2020/0406477 | A1 | 12/2020 | Glisovic et al. | |
| 2020/0408477 | A1 * | 12/2020 | Glisovic | F41A 21/12 |
| 2022/0163280 | A1 * | 5/2022 | Boretto | F41A 21/02 |

* cited by examiner

HYBRID COMPOSITE PROJECTILE BARREL

CROSS-REFERENCE TO RELATED APPLICATION

Pursuant to 35 U.S.C. § 119(e), this application claims the benefit of U.S. Provisional Application No. 63/242,552, filed on Sep. 10, 2021.

STATEMENT REGARDING FEDERALLY SPONSORED RESEARCH OR DEVELOPMENT

This invention was made with government support under Contract No. DOTC-16-01-INIT0603 to Proof Research, Inc., awarded by the U.S. Army. The government has certain rights in the invention.

BACKGROUND OF THE INVENTION

1. Field of the Invention

The present invention relates generally to the field of firearms, and more particularly, to an improved hybrid composite projectile barrel with structural features that are designed to increase the strength of the bonding of the inner steel liner to the continuous fiber composite outer layer in the breech and muzzle transition regions of the barrel.

2. Description of the Related Art

Composite materials are commonly used to enhance the mechanical performance of cylindrical structures such as pressure vessels, pressurized tubes, hydraulic cylinders, power transmission shafts, and projectile barrels (an application of pressurized tubes as suitable for firearm barrels). In many of these use cases, the structural design is comprised of an inner structure and an outer composite layer. In these type of hybrid structures, the inner structure is typically a metal with appropriate physical and mechanical properties, although the inner structure may be manufactured from other materials including ceramics, ceramic matrix composites, refractory materials and composites, or metal matrix composites. The outer composite layer is generally comprised of a polymer matrix with a continuous reinforcement fiber. Carbon fiber is used for applications requiring maximum stiffness and strength and minimal density and total mass. Depending on design requirements, other composite materials may be used with reinforcements such as glass fiber, mineral fiber, metallic fiber, or ceramic fiber as well as other matrix materials such as ceramic, metal, or glass.

Due to dissimilar material properties and differences in material processing between the composite outer layer and inner structure, it is common for high stresses to develop at the interface of the bodies. At this interface, the theoretical strength of the joint is characterized by the strength of the adhesive used to bond the dissimilar bodies. For a hybrid composite barrel, if the stress at the interface exceeds the adhesive strength of the joint, then a fracture and separation of the steel component and outer composite component may occur. When a failure such as separation occurs at the interface, stresses can no longer be effectively shared between the outer composite structure and inner structure; additionally, the separation failure will introduce a crevice that increases the potential for environmental fluid ingress and/or corrosion. The present invention solves the issues of high stress concentration and low adhesive strength at the interface of the dissimilar bodies. By increasing the interface complexity through the use of mechanical locking features, stresses are dissipated more effectively into both the inner structure and composite bodies, minimizing the stress concentration at the adhesive boundary layer between bodies.

Hybrid composite (continuous reinforcement fiber and matrix) firearms barrels can be designed with higher stiffness and strength at a lower mass when compared to a conventional all-steel barrel. Due to the anisotropy of continuous fiber advanced composite materials and the dissimilarities in three-dimensional thermal expansion behavior (Coefficient of Thermal Expansion. CTE) between the composite and steel components, however, thermal stresses often develop within the structure. These thermal stresses are comprised of residual stresses from processing of the hybrid barrel at elevated temperatures and stresses induced as the barrel heats during operation (i.e., firing of the weapon); applied internal and external loads also contribute to stresses within the hybrid structure. If a sufficient difference exists between the thermal expansion characteristics of the outer composite and inner structure in the longitudinal direction (in the case of a firearm barrel, the bore direction), then high thermal stresses may develop at the interface between bodies, leading to an increased chance of failure.

The interfaces of concern for a hybrid composite barrel are typically in the transition regions near the breech and muzzle ends of the barrel. These interfaces are referred to herein as the "Breech Transition Ramp (BTR)" and "Muzzle Transition Ramp (MTR)" respectively. Similar transition regions may exist at other locations in the hybrid composite barrel, for example: (1) the inner structure ramp up to the gas block journal in a gas operated semi-automatic or automatic firearm; (2) a mid-barrel inner structure journal for mounting of sighting devices; or (3) any other transition region in the inner structure required for a particular firearm design. In these regions, thermal stresses manifest as adhesive tensile, shear, and peeling stresses; because the adhesive strength of the joint is very low relative to the strengths of the outer composite layer and the inner structure, a fracture is most likely to occur at the BTR and MTR interfaces due to thermal and mechanical stresses introduced by barrel loading (e.g., heat loads, internal pressure, bending, muzzle brake loads). The geometry of the BTR and MTR strongly influences the stresses that lead to failure of the joint. Steeper ramp angles at these transitions increase normal tensile and peeling stresses, which increase the likelihood of failure at these joints.

U.S. Patent Application Pub. No. 20200408477 (Glisovic et al.) discloses an enhanced meta-metal-matrix composite weapon barrel having a barrel core surrounded by a lightweight, thermally conductive sleeve made from metal, metal-matrix composite (MMC) materials. The barrel core and sleeve include aligning features to prevent separate and movement of the sleeve along the core. These features include annular circumferential "ridges" on the core and "grooves" on the sleeve to engage and prevent separate of the core and sleeve. Unlike the present invention, Glisovic's "sleeve" is not a continuous fiber composite material. The present invention uses discrete notches and pins on the inner liner ("core") that allow for an outer continuous filament wound composite to be physically integrated into the locking feature during manufacture. With the present invention, the notches and/or pins are wound into the inter-laced filament winding of the composite. If a continuous annual circumferential ridge (or groove) were used in connection with a continuous filament-wound barrel, the helical filament winding would simply be wound on top of the ridge (or inside of the groove) and provide no physical locking of the inner liner to the outer composite; therefore, the methodology and structure provided by Glisovic would not work with a continuous filament-wound barrel.

U.S. Patent Application Pub. No. 20070261286 (Briggs) provides a chamber reinforcement for a composite forearm barrel in which the barrel has an inner tube (also called a "liner") and an outer sleeve that is preferably made of a material that is lighter in weight than the tube. Although the term "composite" is used, this invention is not a fiber-reinforced composite barrel, instead, the term "composite" is used to refer to a combination of metal alloys. The invention taught by Briggs is a forging of an outer metallic sleeve to an inner metallic liner. Grooves on the inner liner enable the outer metallic tube to engage the inner tube during the forging process; the two metallic components are forged together and do not form an adhesive bond. By contrast, the present invention teaches a physical interlocking of a continuous fiber-reinforced composite with notches/pins in the breech and muzzle transition regions to improve the adhesive strength of those interfaces.

U.S. patent Ser. No. 11/079,194 (Sinnema, 2021) describes a method for forming a carbon fiber barrel sleeve that is resiliently bonded to a steel liner. With this method, a plurality of flutes is cut into an exterior surface of the barrel liner, thereby defining fins in the interspace between adjacent flutes. A plurality of layers of carbon fiber fabric are laid up on the mandrel to form a sheath, which is then cured and bonded to the barrel liner with a continuous bond of high temperature adhesive at the tips of the fins. This patent describes a deeply fluted steel barrel with a carbon fabric composite sleeve adhesively bonded to the "ridges" of the flutes down the length of the barrel. It does not address the physical interlocking of a continuous composite to features on the steel inner liner, as described in the present invention. As taught by Sinnema, the carbon fiber sheath is laid up, formed and cured on a mandrel having a contour substantially identical to the barrel liner contour; the sheath is then bound to the barrel liner with a high-temperature adhesive or cement. Sinnema does not address nor recognize any inadequacy of adhesive bonding and relies on adhesive bonding of his fabric composite shell to the inner liner. With the present invention, the composite is formed on the inner liner by winding of a continuous filament composite so that it interweaves and interlocks with the notch/pin features at the breech and muzzle transition regions.

U.S. Pat. No. 3,004,361 (Hammer, 1959) discloses a composite lightweight firearm barrel having a steel core with a bore and a plurality of longitudinal grooves formed in the periphery of the core, and a plurality of longitudinal ribs formed by the grooves in the periphery of the core. A plurality of layers of a metal having a desired coefficient of heat transmission and a weight less than that of steel integrally formed in each of the grooves and integrally bonded to the walls of the grooves and to each other to produce laminated-type inlays. This patent involves a barrel with integral ribs machined into the inner line running longitudinally (like fins) to facilitate stiffness and thermal conduction of heat from the barrel. There is no discussion in this patent of any features to enhance adhesive bonding of a structural composite to the steel breech and muzzle ends. In one embodiment, Hammer discusses using fiberglass and resin to fill in the spaces between ribs and overwrapping the barrel in fiberglass for thermal insulation. There is no discussion of features to mechanically interweave/interlock any continuous fiber winding composite to the inner metallic liner.

U.S. patent Ser. No. 10/718,586 (Glisovic, 2020) provides a weapon barrel with a metal alloy core and a barrel jacket made form a metal-matrix material. The jacket and core together form a metal-metal-matrix composite barrel. The attachment of the two components is simply by thermal expansion interference fitting—essentially shrink fitting of the outer shell to the inner liner. There are no provisions in this patent for features on the inner liner to physically interlock the outer composite to the inner liner. Furthermore, the composites described in this patent are non-continuous fiber composites and not suitable for the interweaving/interlocking features of the present invention, which increase the strength of the bonding in the breech and muzzle transition regions.

U.S. Pat. No. 7,721,478 (Withers et al., 2010) describes a fabrication technique for a firearm barrel in which a refractory metal, metal alloy, or ceramic composite inner liner is combined with a metal matrix composite (MMC) or titanium outer shell. There is a compositional gradation from the liner at the inside bore to the overwrap that extends to the outside diameter of the barrel. In one embodiment, refractory metal is deposited on the inner diameter of a pre-fabricated barrel. There is no discussion in this patent of using a conventional metallic liner bonded to a continuous fiber composite outer layer composite using features for interlocking/interweaving the continuous composite filaments, as taught in the present invention. In fact, this patent teaches away from the present invention because it uses a mandrel as a template for the barrel chamber, bore and rifling and deposits refractory metals, ceramic matrix composites, or metal matrix composites on the mandrel template. In this manner, the inventors avoid the interface adhesive bonding issue that is addressed by the present invention.

U.S. Pat. No. 6,567,568 (Christensen, 1997) discloses a composite/metallic gun barrel having a metallic liner and alternating first and second groups of fibers wrapped about the liner. The first and second groups of fibers have different orientations relative to the liner. This patent makes no references to features incorporated on the metallic inner liner to enhance adhesion to the composite outer shell. The figure show an inner liner cross-section with none of these features.

BRIEF SUMMARY OF THE INVENTION

The present invention is an improved hybrid composite projectile barrel comprising: (a) an inner liner having a cylindrical structure, an outer diameter, a first end, a second end, a central portion, a central bore extending longitudinally through a center of the inner liner, a breech transition region, and a muzzle transition region; wherein the central portion of the inner liner is situated between the breech transition region and the muzzle transition region; wherein the breech transition region has an outer diameter that increases from the central portion to the first end of the inner liner; and wherein the muzzle transition region has an outer diameter that increases from the central portion to the second end of the inner liner; (b) an outer composite layer comprised of a matrix with a continuous reinforcement fiber; and (c) a plurality of locking features situated in the breech transition region and on the muzzle transition region.

In a preferred embodiment, the locking features that are situated in the breech transition region are a plurality of ribs that are formed by a plurality of grooves that extend longitudinally from a proximal end of the breech transition region to a distal end of the breech transition region; wherein the locking features that are situated in the muzzle transition region are a plurality of ribs that are formed by a plurality of grooves that extend longitudinally from a proximal end of the muzzle transition region to a distal end of the muzzle transition region; wherein each rib is situated between two adjacent longitudinal grooves; and wherein there are no locking features situated in the central portion of the inner liner. In one embodiment, the ribs are aligned axially relative to the cylindrical structure of the inner liner. In another embodiment, the ribs are aligned helically relative to the cylindrical structure of the inner liner.

In a preferred embodiment, a plurality of notches is cut perpendicularly into a top of each rib, thereby forming a plurality of ridges on each rib; and the notches are shallower than the longitudinal grooves. In a preferred embodiment, each rib has a proximal end and a distal end; wherein each rib in the breech transition region is wider at the proximal end of the rib than it is at the distal end of the rib; wherein each rib in the muzzle transition region is wider at the distal end of the rib than it is at the proximal end of the rib; and wherein each longitudinal groove has a first tapered end, a second tapered end, and a constant width in between the first tapered end and the second tapered end.

In another preferred embodiment, the locking features that are situated in the breech transition region are a plurality of pins that are oriented radially around a circumference of the breech transition region; wherein the locking features that are situated in the muzzle transition region are a plurality of ribs that are oriented radially around a circumference of the muzzle transition region; and wherein there are no locking features situated in the central portion of the inner liner. In one embodiment, the plurality of pins in the breech transition region are arranged in rows that extend longitudinally from a proximal end of the breech transition region to a distal end of the breech transition region; and the plurality of pins in the muzzle transition region are arranged in rows that extend longitudinally from a proximal end of the muzzle transition region to a distal end of the muzzle transition region. In another embodiment, the plurality of pins in the breech transition region are disposed helically around a circumference of the breech transition region; and the plurality of pins in the muzzle transition region are disposed helically around a circumference of the muzzle transition region, in a preferred embodiment, each pin has a height and a top end; wherein the height of the pins gradually increases from the proximal end of the breech transition region to the distal end of the breech transition region such that the top ends of the pins are configured to form a line that is parallel to the outer diameter of the inner liner; and wherein the height of the pins gradually increases from the distal end of the muzzle transition region to the proximal end of the muzzle transition region such that the top ends of the pins are configured to form a line that is parallel to the outer diameter of the inner liner.

In another preferred embodiment, in addition to the ribs with ridges, the invention further comprises a pin that is situated on top of and extends outwardly from each ridge. In this embodiment, each pin has a height; preferably, the height of the pins increases gradually from a proximal end of the breech transition region to a distal end of the breech transition region such that the top ends of the pins are configured to form a line that is parallel to the outer diameter of the inner liner; and, preferably, the height of the pins increases gradually from a distal end of the muzzle transition region to a proximal end of the muzzle transition region such that the top ends of the pins are configured to form a line that is parallel to the outer diameter of the inner liner.

REFERENCE NUMBERS

Figure 1:
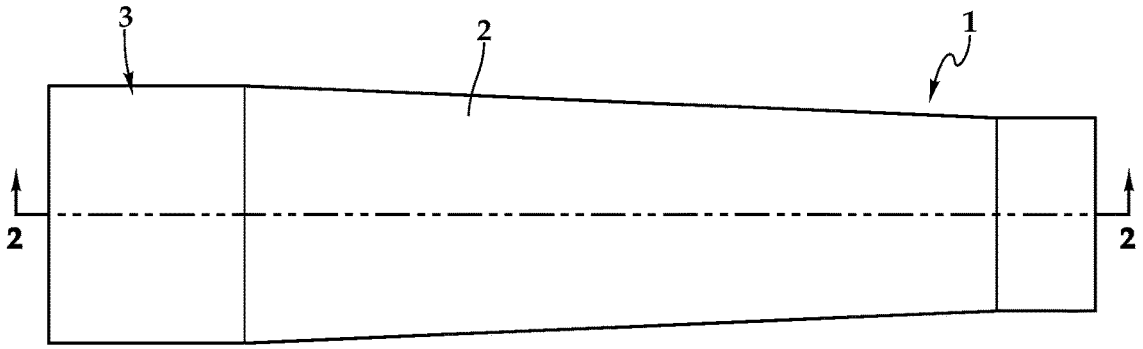
FIG. 1 is a side view of a conventional modern hybrid composite firearm barrel.

1 Firearm barrel
2 Outer composite layer
3 Inner liner
4 Central bore (in inner liner)
5 Ribs
6 Longitudinal grooves
7 Notches
8 Ridges
9 Pins
10 Breech end (of inner liner)
11 Muzzle end (of inner liner)

DETAILED DESCRIPTION OF INVENTION

A. Overview

The present invention is an innovative approach to enhancing the structural integrity of the BTR and MIR interfaces by establishing geometric features that allow interlocking of the composite material to the steel barrel component. These features are incorporated into the inner structure of the hybrid barrel. When the outer composite layer is subsequently added to the inner structure and cured, it is integrally "locked" to the inner structure by the geometric features. With the addition of these features, the integrity of the joint between the composite material component and steel component is not exclusively dependent on adhesive strength; rather, the strength of the joint in this invention is limited by the material characteristics of the constituent structures. This allows for the mechanical locking features at the BTR and MTR interfaces to transfer stresses (thermally induced stresses and mechanical stresses induced by applied loads) more effectively than an adhesive joint.

Applying this mechanical locking joint to a hybrid composite barrel results in an assembly that can withstand substantially higher thermal stresses and stresses from applied loads without failure. This is particularly important in applications where semi-automatic and fully automatic repeating weapons cause barrel temperatures in excess of 1000° F./540° C. At such temperatures, the stresses caused by differences in thermal expansion between composite components and steel components are considerable. In addition, processing of the outer composite body imparts thermal stresses into the hybrid system (because the curing process may require temperatures as high as 750° F./400° C.). These thermal stresses, in combination with stresses caused by applied barrel loads, can easily exceed the adhesive strength of the BTR and MTR composite-steel interfaces; however, by applying this invention to the BTR and MTR, the strength of the interface can be significantly increased while transmitting stresses more effectively from the inner structure to the outer composite body.

The present invention solves this problem by modifying the geometry of the inner structure component in the BTR and MTR regions to provide for mechanical locking of the continuous fiber composite component to the inner structural component. Rather than depending on the adhesive joint of the inner structure and outer composite layer interface, the present invention enables the continuous reinforcement of the composite layer to mechanically integrate with the steel barrel component. This integration achieves two goals: transmitting stresses more effectively from the inner structure to the outer composite layers and increasing the failure strength at the BTR and MTR interfaces. In turn, the improved hybrid composite barrel is able to withstand substantially higher levels of thermally induced and applied load stress at both of these interfaces without failure (separation of the joint).

B. Detailed Description of the Figures

FIG. 1 is a side view of a conventional modern hybrid composite firearm barrel. Conventional modern firearm barrels are circular in cross-section geometry, although the present invention is equally applicable to non-circular cross-section structures. Examples include hexagonal cross-section barrels common in historic firearm designs and any other multifaceted barrel of modern design (e.g., U.S. patent Ser. No. 10/001,337 (Curliss, 2018)). Referring to FIG. 1, the firearm barrel 1 is comprised of an outer composite layer 2 and an inner liner 3. The inner liner 3 is typically made of metal; in a preferred embodiment, this metal is 416 stainless steel.

Figure 2:
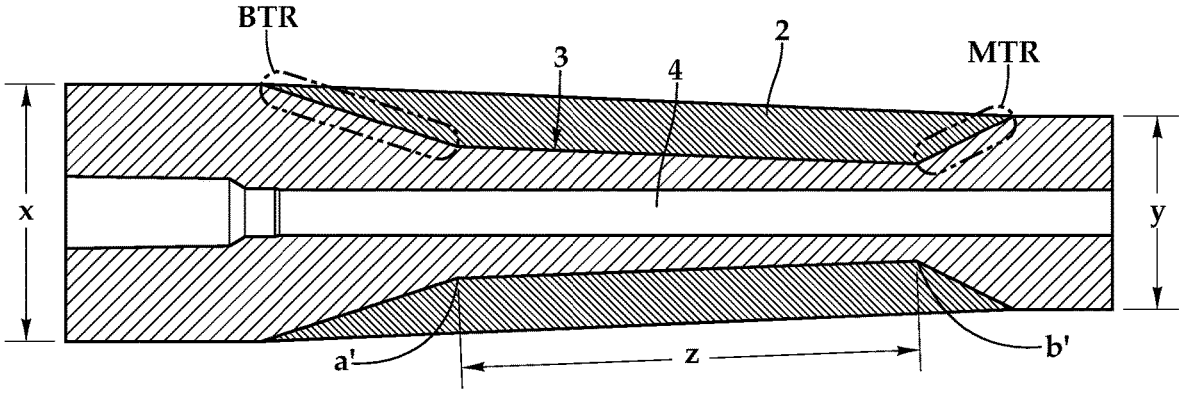
FIG. 2 is a longitudinal section view of a conventional modern hybrid composite firearm barrel.

FIG. 2 is a longitudinal section view of a conventional modern hybrid composite firearm barrel. As shown in this figure, the inner liner 3 comprises a central bore 4 through which the projectile passes when the firearm is discharged. Note that the inner liner has an outer diameter "x." at the breech end of the inner liner and an outer diameter "y" at the muzzle end of the inner liner. The inner liner also has an outer diameter at the central portion (labelled as "z" in FIG. 2) of the inner liner; in this embodiment, the outer diameter decreases gradually from the proximal end of the central portion (a') to the distal end of the central portion (b'). The outer diameter of the inner liner increases sharply from the proximal end of the central portion to the breech end of the inner liner; as noted above, this area is referred to herein as the "Breech Transition Ramp" or BTR region. Similarly, the outer diameter of the inner liner increases sharply from the distal end of the central portion to the muzzle end of the inner liner; as noted above, this area is referred to herein as the "Muzzle Transition Ramp" or MTR region.

Figure 3:
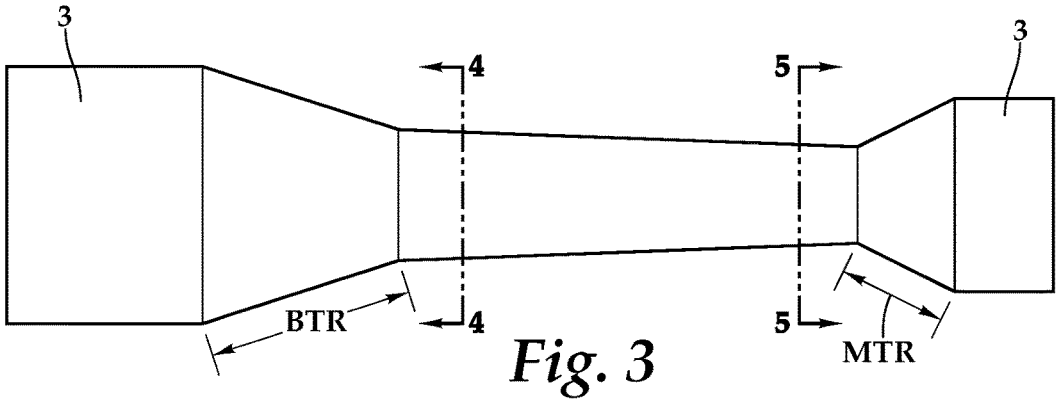
FIG. 3 is a side view of the inner liner of a conventional modern hybrid composite firearm barrel.

FIG. 3 is a side view of the inner liner of a conventional modern hybrid composite firearm barrel. This figure clearly illustrates the BTR and MTR regions of the inner liner.

Figure 4:
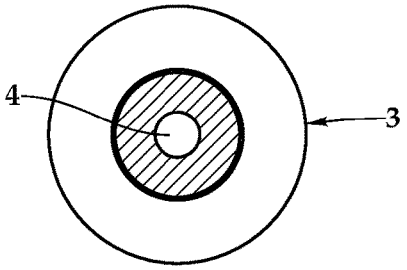
FIG. 4 is a radial section view of the inner liner of a conventional modern hybrid composite firearm barrel taken at the line shown in FIG. 3.
Figure 5:
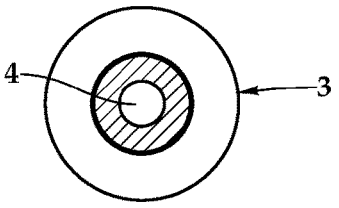
FIG. 5 is a radial section view of the inner liner of a conventional modern hybrid composite firearm barrel taken at the line shown in FIG. 3.

FIG. 4 is a radial section view of the inner liner of a conventional modern hybrid composite firearm barrel taken at the line shown in FIG. 3, and FIG. 5 is a radial section view of the inner liner of a conventional modern hybrid composite firearm barrel taken at the line shown in FIG. 3. These two figures are provided primarily for comparison with FIGS. 9 and 10, 14 and 15, and 19 and 20.

Figure 6:
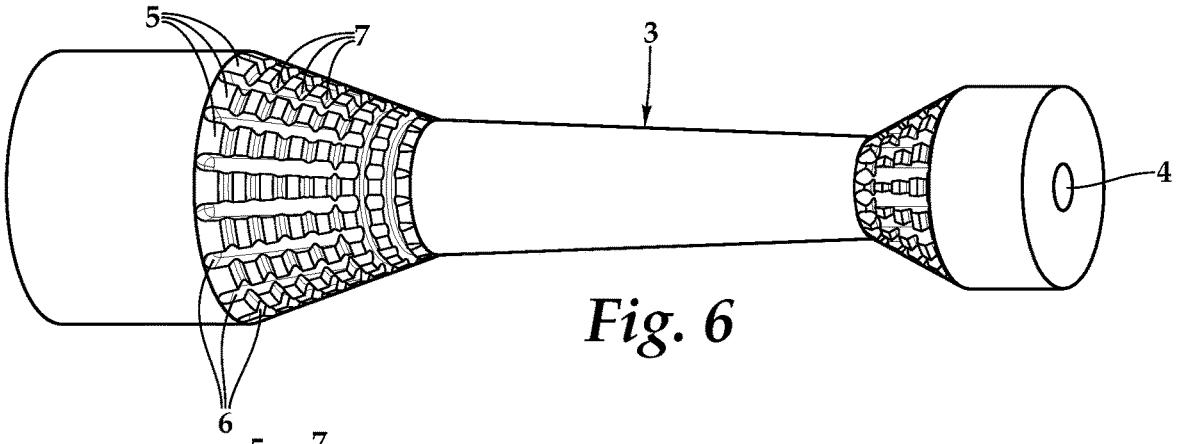
FIG. 6 is a perspective view of a first embodiment of the present invention.

FIG. 6 is a perspective view of a first embodiment of the present invention. In this embodiment, integral notched ribs are incorporated into the BTR and MTR regions of the barrel. As shown in this figure, the ribs 5 are formed by a plurality of grooves 6 that extend longitudinally from a proximal end of the BTR. (c') to a distal end of the BTR (the distal end of the BTR also being the proximal end of the central portion (a')) and a plurality of grooves 6 that extend longitudinally from a proximal end of the MTR (the proximal end of the MTR also being the distal end of the central portion (b') to a distal end of the MTR (d'). It is important to note that there are no ribs 5 (or longitudinal grooves 6) in the central portion of the inner liner 3.

Figure 7:
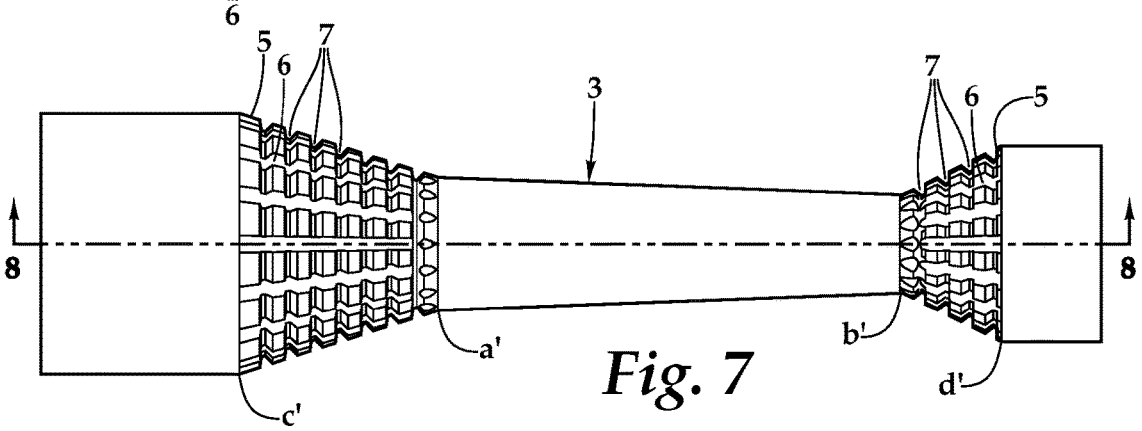
FIG. 7 is a side view of a first embodiment of the present invention.

FIG. 7 is a side view of a first embodiment of the present invention. As shown in this figure, the ribs 5 are aligned axially relative to the cylindrical structure of the inner liner 3, and each rib 5 is situated between two longitudinal grooves 6. In alternate embodiments (not shown), the ribs 5 may be helically pitched (spiraled).

Figure 8:
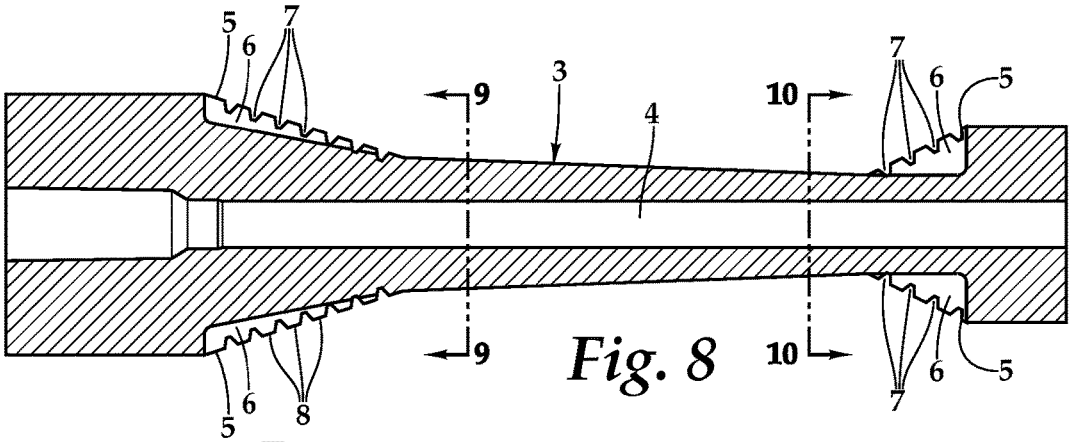
FIG. 8 is a longitudinal section view of a first embodiment of the present invention.

FIG. 8 is a longitudinal section view of a first embodiment of the present invention. As shown in this figure, a plurality of notches 7 is cut perpendicularly (laterally) into the top of each rib 5, thereby forming a plurality of ridges 8. Note that the notches 7 are not as deep as the longitudinal grooves 6; in other words, the notches 7 are shallower than the longitudinal grooves 6. The notches 7 are preferably trough-shaped (that is, with two angled side walls and a floor that is narrower than the open end of the trough) evenly spaced on the ribs 5.

Figure 9:
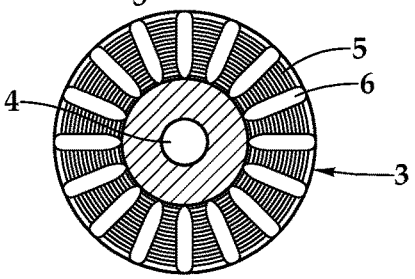
FIG. 9 is a radial section view of a first embodiment of the present invention taken at the line shown in FIG. 8.
Figure 10:
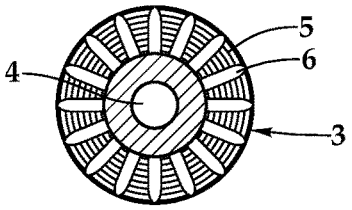
FIG. 10 is a radial section view of a first embodiment of the present invention taken at the line shown in FIG. 8.

FIG. 9 is a radial section view of a first embodiment of the present invention taken at the line shown in FIG. 8, and FIG. 10 is a radial section view of a first embodiment of the present invention taken at the line shown in FIG. 8. It is clear from these two figures that each rib 5 in the BTR region (shown in FIG. 9) is wider at its proximal end (c') than it is at its distal end (a'), and each rib 5 in the MTR region (shown in FIG. 10) is wider at its distal end (d') than at its proximal end (b'). By contrast, the longitudinal grooves 6 preferably have a constant width except at their tips, where they taper to a point.

When the outer composite layer is added to the inner structure (liner), the composite material is cured as it is interlocked with the ribs and notches, thereby providing for effective sharing of stresses between the inner and outer structures (the inner structure being the inner liner 3 and the outer structure being the outer composite layer 2). Although a preferred embodiment is shown in FIGS. 6-10, the geometry of the ribs 5 may vary widely depending on the design requirements of the structure. The geometric factors that may be varied to optimize the performance of the ribs include, but are not limited to: the number of ribs; the width of the rib relative to the channel or spacing between the ribs; whether each rib has a constant or tapered width in both the radial and longitudinal directions relative to the axis of the cylindrical structure; the number of notches in each rib; the spacing of the notches along the top of each rib (including the spacing of notches relative to adjacent ribs); the geometry of each notch (i.e., the width, depth and angles of notch surfaces relative to the axis of the cylindrical structure); and whether each longitudinal groove has a constant or tapered width in both the radial and longitudinal directions relative to the axis of the cylindrical structure.

Figure 11:
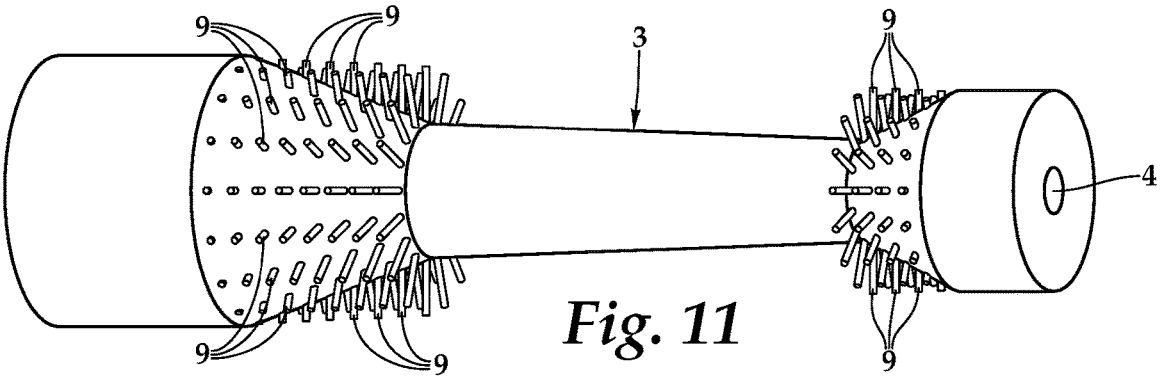
FIG. 11 is a perspective view of a second embodiment of the present invention.

FIG. 11 is a perspective view of a second embodiment of the present invention. In this embodiment, integral locking pins are incorporated into the BTR and MTR regions of the barrel. In this embodiment, integral locking pins are oriented radially around the circumference of the BTR and MTR regions of the barrel. This locking feature performs the same function as the integral notched rib embodiment, which is to increase stress transfer between the outer composite layer 2 and the inner liner 3, thereby increasing the strength of the assembly and preventing adhesive fracture at the interfaces. Stress transfer may be optimized by canting the pins at an angle toward either end of the cylindrical assembly (not shown). When the outer composite material is added to the inner structure during manufacturing, the composite material engages the pins at the BTR and MTR regions. After curing the composite becomes structurally integrated with the inner liner 3, dramatically increasing the strength of the joint at the transition regions.

Referring to FIG. 11, in this embodiment, a plurality of pins 9 extends radially outward in the BTR and MTR regions of the barrel. In the embodiment shown in FIG. 11, the pins are arranged in rows that extend longitudinally from a proximal end of the BTR (c') to a distal end of the BTR (the distal end of the BTR also being the proximal end of the central portion (a')) and from a proximal end of the MTR (the proximal end of the MTR also being the distal end of the central portion (b') to a distal end of the MTR (d'). In this particular embodiment, because the width of the BTR at a' is less than the width of the BTR at c' and the width of the MTR at b' is less than the width of the MTR at d', the spacing between the rows of pins 9 is greater at c' and d' than it is at a' and b' (see also FIG. 12). As with the ribs, the pins may be disposed helically (spirally) rather around the MTR and BTR regions rather than arranged in rows.

Figure 12:
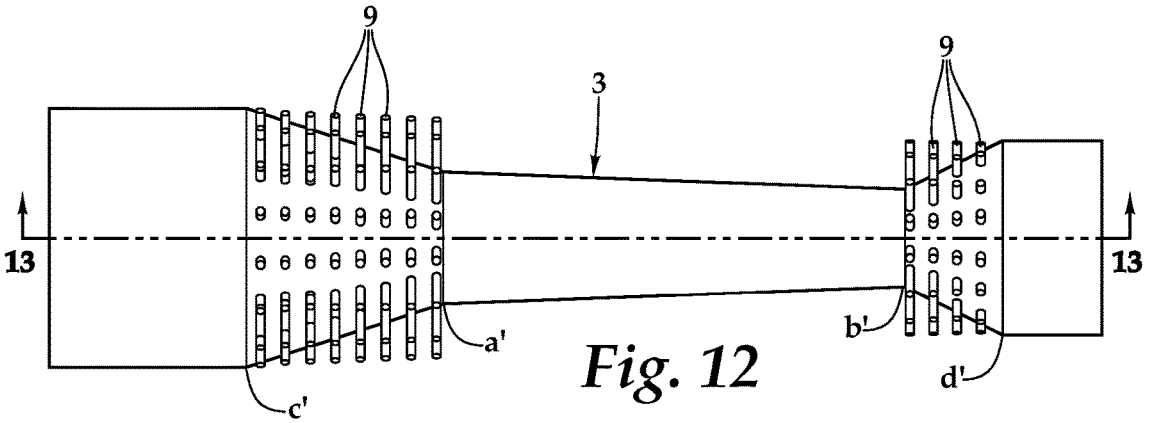
FIG. 12 is a side view of a second embodiment of the present invention.

FIG. 12 is a side view of a second embodiment of the present invention. As shown in this figure, there are no pins 9 in the central portion of the inner liner 3.

Figure 13:
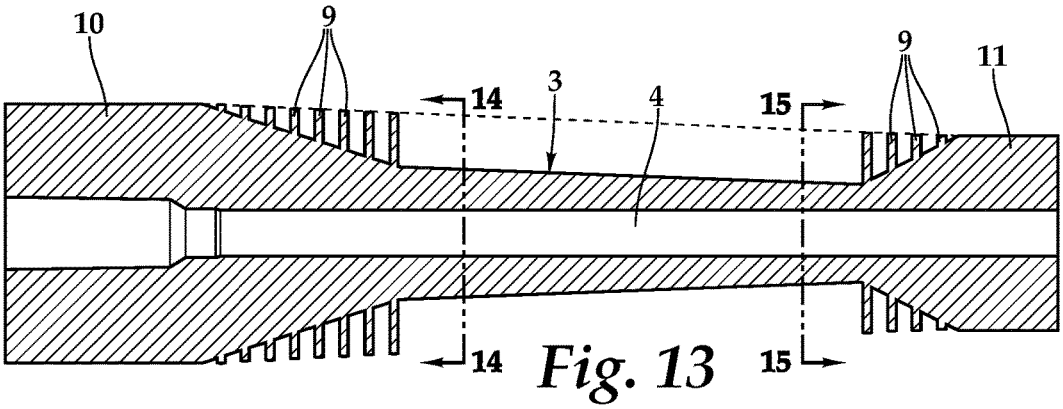
FIG. 13 is a longitudinal section view of a second embodiment of the present invention.

FIG. 13 is a longitudinal section view of a second embodiment of the present invention. As shown in this figure, the height of each individual pin 9 preferably increases from c' to a' and from d' to b' so that the top ends of all of the pins 9 from c' to d' in the BTR region form a line that is parallel to the outer diameter of the central portion of the inner liner 3. While standard rifle barrels (that is, the central portion of a rifle barrel) taper from breech to muzzle, high-precision rifles will often use a barrel with far less taper, called a "heavy barrel." sometimes leaving the barrel cylindrical all the way to the muzzle, called a "hull barrel."

Figure 14:
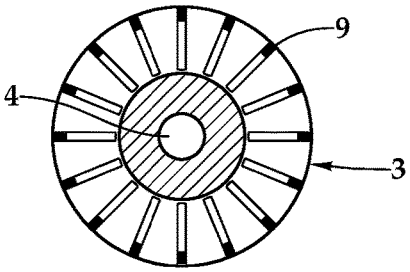
FIG. 14 is a radial section view of a second embodiment of the present invention taken at the line shown in FIG. 13.
Figure 15:
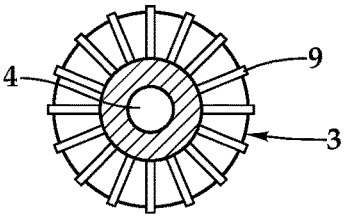
FIG. 15 is a radial section view of a second embodiment of the present invention taken at the line shown in FIG. 13.

FIG. 14 is a radial section view of a second embodiment of the present invention taken at the line shown in FIG. 13, and FIG. 15 is a radial section view of a second embodiment of the present invention taken at the line shown in FIG. 13. As depicted in these views, the pins 9 are arranged in rows that correspond to the ribs 5 of the previous invention.

As with the first embodiment (interlocking ribs), the geometry of the pins 9 may be varied depending on the design requirements of the structure. The geometric factors that may be varied to optimize the performance of the interlocking pins include, but are not limited to: the number of pins; the diameter of the pins; the radial height of the pins; the spacing of the pins in the longitudinal and circumferential directions around the BTR and MTR regions; and the geometry and shape of individual pins to facilitate interlocking of the composite to the inner structure.

Figure 16:
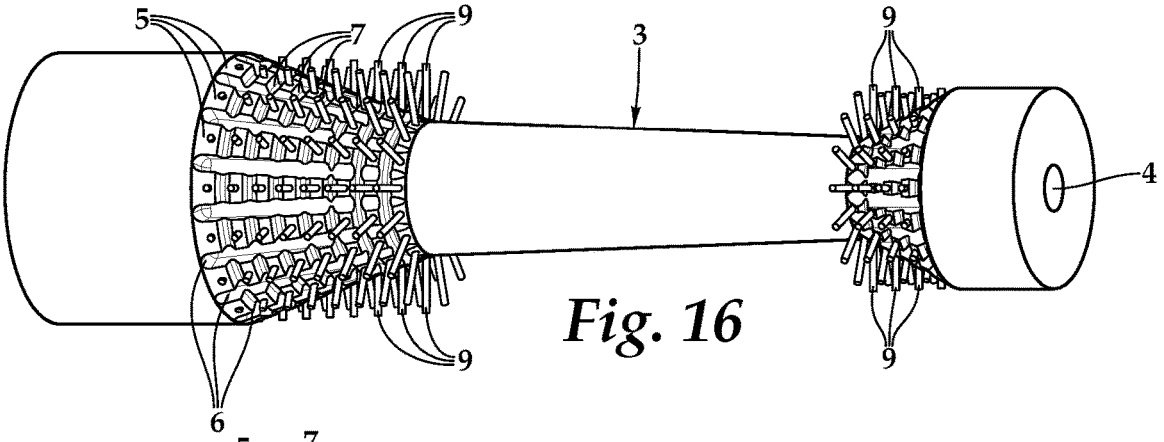
FIG. 16 is a perspective view of a third embodiment of the present invention.

FIG. 16 is a perspective view of a third embodiment of the present invention. In this embodiment, the interlocking ribs 5 of the first embodiment are combined with the interlocking pins 9 of the second embodiment. In this embodiment, a single pin 9 is situated on top of each ridge 8 on the rib 5. As with the second embodiment, the height of each pin 9 is adjusted so that the top ends of the pins 9 form a line that is parallel to the outer diameter of the inner liner.

Figure 17:
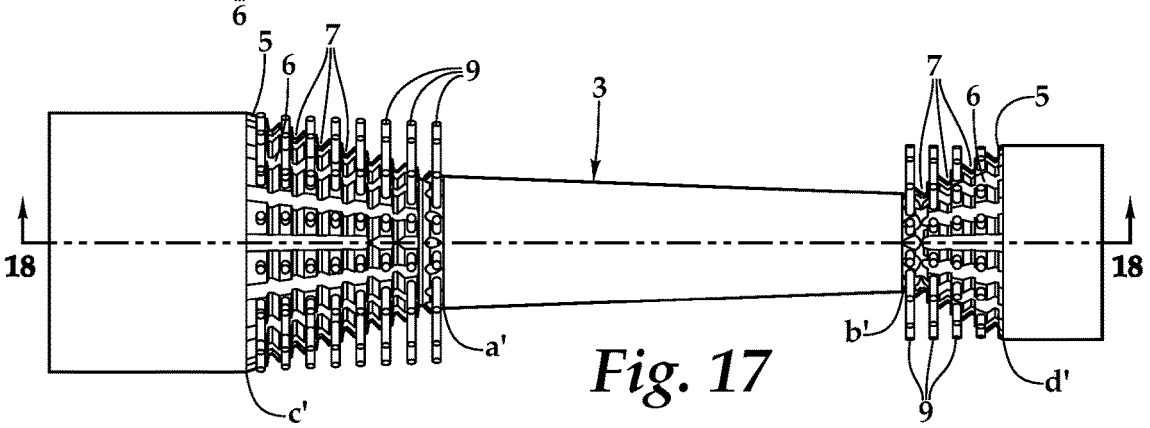
FIG. 17 is a side view of a third embodiment of the present invention.

FIG. 17 is a side view of a third embodiment of the present invention. When used together, the ribs 5 and pins 9 provide increased interface strength and mass reduction with additional reinforcement of the outer composite layer to the inner structure joint. For applications where only the interlocking pins 9 are used, mass reduction and additional joint reinforcement are not present, but the assembly will still experience enhanced stress transfer between the inner structure and outer composite layer.

Figure 18:
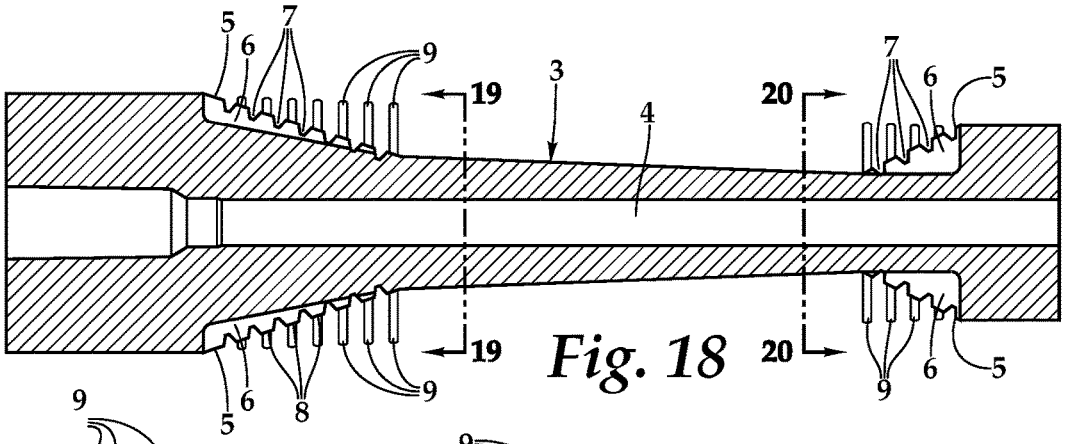
FIG. 18 is a longitudinal section view of a third embodiment of the present invention.

FIG. 18 is a longitudinal section view of a third embodiment of the present invention. The present invention is not limited to any particular placement, number of geometry of pin integration with the ribs. With all three embodiments (interlocking ribs, interlocking pins, or interlocking ribs and pins), the angle of the BTR and MTR regions may be adjusted to provide greater or lesser engagement between the locking features and the outer composite layer; for example, if the angle is made less steep (so that the BTR and MTR regions are longer), greater surface area is provided for the locking features.

Figure 19:
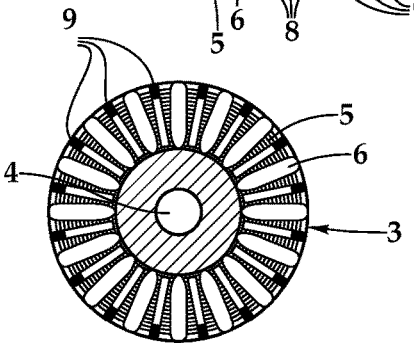
FIG. 19 is a radial section view of a third embodiment of the present invention taken at the line shown in FIG. 18.
Figure 20:
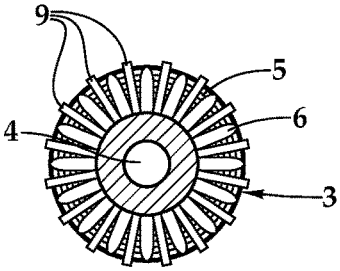
FIG. 20 is a radial section view of a third embodiment of the present invention taken at the line shown in FIG. 18.

FIG. 19 is a radial section view of a third embodiment of the present invention taken at the line shown in FIG. 18, and FIG. 20 is a radial section view of a third embodiment of the present invention taken at the line shown in FIG. 18. As shown in this figure, the pins 9 are disposed in between the longitudinal grooves 6, and both the pins 9 and the longitudinal grooves 6 are evenly spaced concentrically around the BTR and MTR regions of the barrel.

Figure 21:
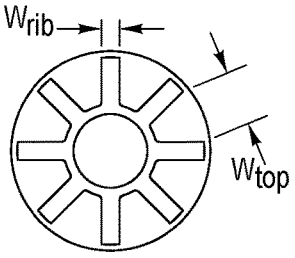
FIG. 21 is a diagram of the rib width as compared to the rib top space in a first embodiment of the present invention.

FIG. 21 is a diagram of the rib width as compared to the rib top space in a first embodiment of the present invention. The mass reduction advantage of the present invention as compared to a conventional structure can be simulated by comparing the mass of a BTR or MTR locking feature (ribs or pins) to a conventional BTR or MTR inner structure. The mass reduction is quantified by comparing the mass of a conventional "solid" MTR to the interlocking ribs (INR) embodiment described above (FIGS. 6-10) based on geometric feature size:

$$\text{Rib Ratio}=W_{rib}/W_{top}$$

The $W_{rib}$ and $W_{top}$ parameters are defined in FIG. 21; however, FIG. 21 depicts an embodiment in which the ribs 5 are of a constant diameter, and the longitudinal grooves 6 are tapered (that is, wider at the top than at the bottom).

Figure 22:
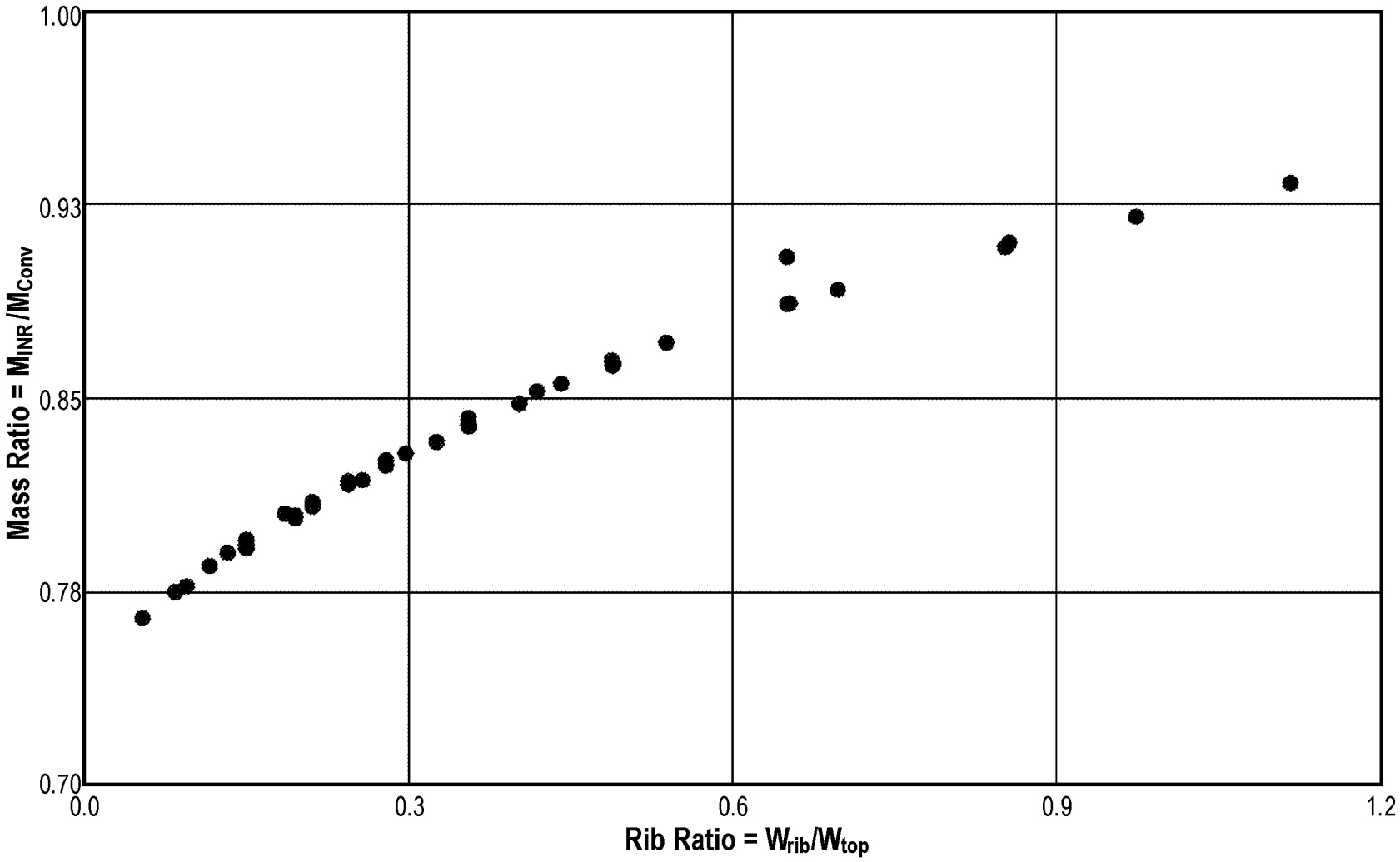
FIG. 22 is a graph illustrating the relationship between mass ratio $M_{INR}/M_{CONV}$ to rib ratio $W_{Rib}/W_{Top}$.

FIG. 22 is a graph illustrating the relationship between mass ratio $M_{INR}/M_{CONV}$ and rib ratio $W_{Rib}/W_{Top}$. The mass ratio of the interlocking rib features to the conventional BTR or MTR region is defined as:

$$\text{Mass Ratio}=M_{INR}/M_{Conv}$$

In FIG. 22, the mass ratio is plotted as a function of the rib ratio to yield the weight comparison of the INR locking feature BTR or MTR to the conventional BTR or MTR. In this example, there is a potential mass reduction of up to approximately twenty-five percent (25%) at low rib ratio values (~0.05). The opportunity for further mass reduction is possible at the cost of manufacturability.

The locking features incorporated at the BTR and MTR interfaces effectively lock the outer composite layer to the inner structure, enabling stress transfer between the two layers of the structure. The INR or interlocking pins (ILP) features are manufactured as part of the inner liner (or manufactured separately and subsequently incorporated into the inner structure), and composite is applied over the inner structure using any number of composite material preforms and manufacturing techniques. The outer composite may be applied over the inner structure by wet filament winding, towpreg filament winding, wrapping with a unidirectional prepreg textile or braid, or by wrapping with an unimpregnated dry reinforcement (fiber, fabric, or weave), followed by an infusion with a suitable resin. After application of the composite preform over the inner structure and INR or ILP features, the composite is processed as required to create a suitable structural material. The outer composite layer may be molded to its final net shape or machined to dimension requirements and, if necessary, finished with any additional functional layers, protective coverings, or cosmetic coatings. After processing of the composite outer layer, the material possesses its ultimate strength and stiffness characteristics and is fully integrated into the locking features of the inner structure, providing a high-strength joint.

Stress simulations and analysis performed using SOLIDWORKS 2020 SP 5.0 and ANSYS 2022 R5 were performed to evaluate the effectiveness of the INR features on stress transfer between the inner structure and outer composite layer. Stress simulations were performed for a cylindrical firearm barrel possessing a conventional inner structure without locking features and a cylindrical barrel incorporating INR locking features to an identical geometric body. Both simulations were performed using identical steel alloy and composite properties and an identical composite layup. Comparing the benefits of INR features at the MTR interface, a 10,000 lb representative muzzle brake force (accurate for a medium caliber firearm barrel) was applied as a tensile load to the muzzle end of the barrel system, but thermal loads were not applied to the barrel for this analysis. In the control case, the stress field resulting from the boundary conditions showed that the stresses are transferred entirely to the inner structure, with essentially zero stress in the outer composite. Inner structure stress levels to the inside of the MTR region averaged approximately 20.600 psi. In the INR test case, the stress field resulting from the boundary conditions showed that the stresses were shared between the inner structure and the outer composite layer. Inner structure stress levels to the inside of the MTR region averaged approximately 7000 psi, while the outer composite reached stress levels of approximately 4000 psi. Through the application of INR to the MTR region of the inner structure, stress levels on the inner structure were reduced by greater than 65%.

The locking features of the present invention have several characteristics that enhance the strength of the joint between bodies, namely:

1) Increasing the taper of the BTR and MTR using the INR design allows the stress transfer between the layers to be spread over a longer effective joint without adding mass. Because the spaces between the ribs represent material removed from the inner structure, the overall mass of the BTR and MTR can be reduced while increasing the taper length of the BTR and MTR to increase effectiveness at locking the inner structure to the outer composite layer. In other words, the longer the taper (less steep angle) of the BTR and MTR, the greater the surface area on which to place the locking features.
2) The INR ribs have locking notches spaced along their outer radial surface to enable the composite to be physically attached to the rib through an interference of materials, not just an adhesively bonded joint as would be used in a conventional BTR or MTR.
3) The spacing of the INR notched rib features create a faceted surface plane of the inner structure. In this embodiment, the bottom of the notches in the rib features define a plane that lies below the tapered surface defined by the outermost edges of the inner structure ribs. The depth of this plane below the outer circular surface defines the material interference that enables the high degree of stress transfer.
4) If filament winding is used to manufacture the outer composite layer (dry fiber tow, wet filament tow winding, or towpreg winding), the INR and ILP locking features enable a winding path to be designed so that the trajectory of fiber is aligned with the notches and/or pins in the BTR and MTR locking features to maximize the strength of the joint.

The advantage of the locking effect of INR or ILP is demonstrated by the evaluating the strength of a joint with these locking features versus the adhesive strength of a joint without locking notches. With an INR or ILP locking notch or pin, any stresses between the outer composite layer and the inner liner are transferred directly into the composite material as primarily tensile stresses in the composite material. In the case of an adhesive joint between the outer composite layer and the inner liner, the stresses are transferred between the layers through tensile and/or shear stresses on the adhesive joint. A comparison of the maximum stresses possible before failure of the joint in these two cases illustrates the advantage of the INR and ILP locking features. Advanced continuous composite materials typically have tensile strengths one or two orders of magnitude higher than tensile and shear strengths of adhesive joints. In an advanced continuous fiber composite material typically used as the outer layer composite, the tensile strength is typically 200,000 to 400,000 psi. By comparison, the adhesive tensile or shear strength of a joint between an advanced continuous fiber composite and a metallic liner is typically 2000 to 8000 psi.

There are no known comparable solutions to the problem of enhancing the stress transfer between dissimilar materials in a hybrid composite structure. Solutions typically employed include mechanical fasteners (e.g., bolts and nuts) or simply relying on the adhesive strength of the joint between the dissimilar materials. Mechanical fasteners, such as bolts, add additional weight, are unsuitable for pressure vessels and tubes, and weaken the structure in some respects since this approach requires holes through the structural materials. Relying on adhesively bonded joints works well in many cases but not in cases in which the thermally induced or mechanically applied load stresses exceed the adhesive strength between the outer composite layer and the inner structure.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. An improved hybrid composite projectile barrel comprising:

(a) an inner liner having a cylindrical structure, an outer diameter, a first end, a second end, a central portion, a central bore extending longitudinally through a center of the inner liner, a breech transition region, and a muzzle transition region;

wherein the central portion of the inner liner is situated between the breech transition region and the muzzle transition region;

wherein the breech transition region has an outer diameter that increases from the central portion to the first end of the inner liner; and wherein the muzzle transition region has an outer diameter that increases from the central portion to the second end of the inner liner;

(b) an outer composite layer comprised of a matrix with a continuous reinforcement fiber; and (c) a plurality of locking features situated in the breech transition region and on the muzzle transition region.

2. The improved hybrid composite projectile barrel of claim 1, wherein the locking features that are situated in the breech transition region are a plurality of ribs that are formed by a plurality of grooves that extend longitudinally from a proximal end of the breech transition region to a distal end of the breech transition region;

wherein the locking features that are situated in the muzzle transition region are a plurality of ribs that are formed by a plurality of grooves that extend longitudinally from a proximal end of the muzzle transition region to a distal end of the muzzle transition region;

wherein each rib is situated between two adjacent longitudinal grooves; and wherein there are no locking features situated in the central portion of the inner liner.

3. The improved hybrid composite projectile barrel of claim 2, wherein the ribs are aligned axially relative to the cylindrical structure of the inner liner.

4. The improved hybrid composite projectile barrel of claim 2, wherein the ribs are aligned helically relative to the cylindrical structure of the inner liner.

5. The improved hybrid composite projectile barrel of claim 2, wherein a plurality of notches is cut perpendicularly into a top of each rib, thereby forming a plurality of ridges on each rib; and wherein the notches are shallower than the longitudinal grooves.

6. The improved hybrid composite projectile barrel of claim 2, wherein each rib has a proximal end and a distal end;

wherein each rib in the breech transition region is wider at the proximal end of the rib than it is at the distal end of the rib;

wherein each rib in the muzzle transition region is wider at the distal end of the rib than it is at the proximal end of the rib; and wherein each longitudinal groove has a first tapered end, a second tapered end, and a constant width in between the first tapered end and the second tapered end.

7. The improved hybrid composite projectile barrel of claim 1, wherein the locking features that are situated in the breech transition region are a plurality of pins that are oriented radially around a circumference of the breech transition region;

wherein the locking features that are situated in the muzzle transition region are a plurality of pins that are oriented radially around a circumference of the muzzle transition region; and wherein there are no locking features situated in the central portion of the inner liner.

8. The improved hybrid composite projectile barrel of claim 7, wherein the plurality of pins in the breech transition region are arranged in rows that extend longitudinally from a proximal end of the breech transition region to a distal end of the breech transition region; and wherein the plurality of pins in the muzzle transition region are arranged in rows that extend longitudinally from a proximal end of the muzzle transition region to a distal end of the muzzle transition region.

9. The improved hybrid composite projectile barrel of claim 7, wherein the plurality of pins in the breech transition region are disposed helically around a circumference of the breech transition region; and wherein the plurality of pins in the muzzle transition region are disposed helically around a circumference of the muzzle transition region.

10. The improved hybrid composite projectile barrel of claim 7, wherein each pin has a height and a top end:

wherein the height of the pins gradually increases from the proximal end of the breech transition region to the distal end of the breech transition region such that the top ends of the pins are configured to form a line that is parallel to the outer diameter of the inner liner; and wherein the height of the pins gradually increases from the distal end of the muzzle transition region to the proximal end of the muzzle transition region such that the top ends of the pins are configured to form a line that is parallel to the outer diameter of the inner liner.

11. The improved hybrid composite projectile barrel of claim 5, further comprising a pin that is situated on top of and extends outwardly from each ridge.

12. The improved hybrid composite projectile barrel of claim 11, wherein each pin has a height; and wherein the height of the pins increases gradually from a proximal end of the breech transition region to a distal end of the breech transition region such that the top ends of the pins are configured to form a line that is parallel to the outer diameter of the inner liner; and wherein the height of the pins increases gradually from a distal end of the muzzle transition region to a proximal end of the muzzle transition region such that the top ends of the pins are configured to form a line that is parallel to the outer diameter of the inner liner.

* * * * *